US007645370B2

(12) United States Patent
Tai et al.

(10) Patent No.: US 7,645,370 B2
(45) **Date of Patent: *Jan. 12, 2010**

(54) PLATING RESIN MOLDED ARTICLE AND PROCESS FOR PRODUCING THE SAME

(75) Inventors: Toshihiro Tai, Osaka (JP); Ippei Tonosaki, Osaka (JP)

(73) Assignee: Daicel Polymer Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/238,909

(22) Filed: Sep. 10, 2002

(65) Prior Publication Data

US 2003/0059621 A1 Mar. 27, 2003

(30) Foreign Application Priority Data

| | | |
|---|---|---|
| Sep. 11, 2001 | (JP) | 2001-274447 |
| Nov. 28, 2001 | (JP) | 2001-363109 |
| Apr. 3, 2002 | (JP) | 2002-100768 |

(51) Int. Cl.

| | |
|---|---|
| ***C25D 5/56*** | (2006.01) |
| ***C23C 18/52*** | (2006.01) |
| ***C23C 18/28*** | (2006.01) |
| ***C23C 18/30*** | (2006.01) |
| ***C23C 18/22*** | (2006.01) |
| ***C23C 18/24*** | (2006.01) |

(52) U.S. Cl. ..... 205/167; 205/169; 205/187; 427/304; 427/306; 427/404; 427/443.1

(58) Field of Classification Search ..... 427/304, 427/305, 306, 307; 205/167

See application file for complete search history.

(56) References Cited

U.S. PATENT DOCUMENTS

| | | | | | |
|---|---|---|---|---|---|
| 3,607,350 | A | * | 9/1971 | Rathsack | 427/306 |
| 3,819,394 | A | * | 6/1974 | Schnebel et al. | 427/444 |
| 3,951,791 | A | * | 4/1976 | Huang et al. | 210/734 |
| 4,085,088 | A | * | 4/1978 | Miyata et al. | 523/205 |
| 4,278,739 | A | | 7/1981 | Coll-Palagos | |
| 4,386,175 | A | * | 5/1983 | Kuramochi et al. | 524/32 |
| 4,452,858 | A | * | 6/1984 | Take et al. | 428/33 |
| 4,559,143 | A | * | 12/1985 | Asada et al. | 210/714 |
| 4,732,807 | A | * | 3/1988 | Maeda et al. | 428/327 |
| 4,751,146 | A | * | 6/1988 | Maeda et al. | 428/475.8 |
| 4,764,401 | A | * | 8/1988 | Sirinyan et al. | 427/304 |
| 4,786,685 | A | * | 11/1988 | Takida et al. | 525/58 |
| 4,876,145 | A | * | 10/1989 | Maeda et al. | 428/327 |
| 5,143,592 | A | * | 9/1992 | Toro | 205/210 |
| 5,225,465 | A | * | 7/1993 | Eichenauer et al. | 524/100 |
| 5,230,927 | A | * | 7/1993 | Nishizawa et al. | 427/306 |
| 5,326,811 | A | * | 7/1994 | Sano et al. | 524/505 |
| 5,370,934 | A | | 12/1994 | Burch et al. | |
| 5,408,005 | A | * | 4/1995 | Heim et al. | 525/252 |
| 6,861,097 | B1 | * | 3/2005 | Goosey et al. | 427/304 |

FOREIGN PATENT DOCUMENTS

| | | | |
|---|---|---|---|
| DE | 44 04 750 | * | 8/1995 |
| GB | 1 219 194 | | 1/1971 |
| JP | 61-120857 | | 6/1986 |
| JP | 62-109826 | * | 5/1987 |
| JP | 06280039 A | * | 10/1994 |
| JP | 08253869 A | | 10/1996 |
| JP | 11181218 A | | 7/1999 |
| JP | 11310880 A | | 11/1999 |
| JP | 2000154266 A | | 6/2000 |

* cited by examiner

*Primary Examiner*—Katherine A Bareford
(74) *Attorney, Agent, or Firm*—Flynn, Thiel, Boutell & Tanis, P.C.

(57) ABSTRACT

The present invention is a plated resin molded article and process of producing the plated resin molded article, wherein metal plating is carried out on the surface of a thermoplastic resin molded article and either of requirements (1), (2) and (3) described below is included:

(1) the thermoplastic resin molded article contains a thermoplastic resin and a water-soluble substance, a step of carrying out the removal of fat from the resin molded article and a step of electroless plating are provided in combination, and a step of etching by an acid containing a heavy metal is not included;

(2) the thermoplastic resin molded article contains a polyamide-based resin and a styrene-based resin, a step of carrying out the removal of fat from the resin molded article and a step of electroless plating are provided in combination, and a step of etching by an acid containing a heavy metal is not included; or (3) a step of contact-treating the thermoplastic resin molded article with an acid or base not containing a heavy metal as the pre-treatment of the metal plating step is included.

16 Claims, No Drawings

PLATING RESIN MOLDED ARTICLE AND PROCESS FOR PRODUCING THE SAME

TECHNICAL FIELD OF THE INVENTION

The present invention relates to a plated resin molded article having a high plating strength and a production process thereof. It does not use a heavy metal composition such as chromic acid.

PRIOR ART

Resin molded articles such as an ABS resin and a polyamide resin have been used as automobile parts for the purpose of reducing the weight of an automobile, and plating, such as copper or nickel, is carried out on the resin molded articles in order to give them an upscale image and a sense of beauty.

When the plating is carried out on resin molded articles such as an ABS resin, an etching step of roughening the surface of the resin molded articles is conventionally essential to enhance the adhering strength after a fat removal step. For example, when an ABS resin molded article and a polypropylene molded article are plated, a bath of chromic acid (a mixed solution of chromium (III) oxide and sulfuric acid) is used after the fat removal step, and an etching treatment is required to be carried out at 65 to 70° C. for 10 to 15 minutes. Accordingly, poisonous hexa-valent chromic acid ion is contained in waste water. Therefore, a treatment of neutrally precipitating after reducing the hexa-valent chromic acid ion to a tri-valent ion is essential, and there is a problem at the time of waste water treatment.

Considering safety and an influence to the environment due to the waste water, it is desirable not to carry out an etching treatment using the chromium bath, but in that case, there is a problem that the adhering strength of a plating layer to a molded article which is obtained by an ABS resin and the like cannot be enhanced.

DISCLOSURE OF THE INVENTION

The present invention is a process of producing a plated resin molded article, wherein metal plating is carried out on the surface of a thermoplastic resin molded article and either of requirements (1), (2) and (3) described below is included:

(1) the thermoplastic resin molded article contains a thermoplastic resin and a water-soluble substance, a step of carrying out the removal of fat from the resin molded article and a step of electroless plating are provided in combination, and a step of etching by an acid containing a heavy metal is not included;

(2) the thermoplastic resin molded article contains a polyamide-based resin and a styrene-based resin, a step of carrying out the removal of fat from the resin molded article and a step of electroless plating are provided in combination, and a step of etching by an acid containing a heavy metal is not included; or (3) a step of contact-treating the thermoplastic resin molded article with an acid or base not containing a heavy metal as the pre-treatment of the metal plating step is included.

The present invention further provides a plating resin molded article obtained by the above-mentioned step.

Heavy metal-containing compounds such as chromic acid are not used in the present invention.

The present invention also provides a process of producing a plated resin molded article, wherein metal plating is carried out on the surface of a thermoplastic resin molded article and either of requirements (1), (2) and (3) described below is included:

(1) the thermoplastic resin molded article contains a thermoplastic resin and a water-soluble substance, a step of carrying out the removal of fat from the resin molded article is provided, and the metal plating is conducted by a step of electroless plating;

(2) the thermoplastic resin molded article contains a polyamide-based resin and a styrene-based resin, a step of carrying out the removal of fat from the resin molded article and a step of electroless plating is provided, and the metal plating is conducted by a step of electroless plating; or (3) a step of contact-treating the thermoplastic resin molded article with an acid or base not containing a heavy metal as the pre-treatment of the metal plating step is included.

The present invention includes the following three modes of invention in accordance with each of the above-mentioned requirements (1), (2) and (3).

Mode (1) (Water-Soluble Substance)

It is an object of the present invention to provide a plated resin molded article having a high adhering strength between the resin molded article and a plating layer and having a beautiful appearance, and to provide a production process of the aforementioned plated resin molded article which does not require an etching treatment by chromic acid and the like.

The present inventor has found that an adhering strength between a resin molded article and a plating layer can be remarkably enhanced by compounding a water-soluble substance and if necessary, a surfactant and the like to a thermoplastic resin to prepare the resin molded article without an etching treatment by an acid containing a heavy metal such as chromic acid, and completed the present invention.

As a procedure of solving the above-mentioned object, the present invention provides a plated resin molded article which has a metal plating layer on the surface of a resin molded article containing a thermoplastic resin and a water-soluble substance, wherein an etching treatment by an acid containing a heavy metal is not carried out on the resin molded article.

Further, as other solving means for the above-mentioned object, the present invention provides a production process of a plating resin molded article which comprises a step of removal of fat from the resin molded article containing a thermoplastic resin and a water-soluble substance and a step of electroless plating and does not include a step of etching by an acid containing a heavy metal.

Mode (2) (Polyamide-Based Resin and Styrene-Based Resin)

It is an object of the present invention to provide a production process of the aforementioned plated resin molded article having a high adhering strength between the resin molded article and a plating layer and having a beautiful appearance and not requiring an etching treatment by chromic acid and the like.

The present inventor has found that an adhering strength between a resin molded article and a plating layer can be enhanced by making a resin molded article which contains a polyamide-based resin and a styrene-based resin, without an etching treatment by an acid containing a heavy metal such as chromic acid, and further, the adhering strength can be remarkably enhanced by containing an additional component in the resin molded article, and completed the present invention.

As a solving means of the above-mentioned object, the present invention provides a plated resin molded article which has a metal plating layer on the surface of a resin molded article containing a polyamide-based resin and a styrene-based resin, wherein the resin molded article is an article to which an etching treatment by an acid containing a heavy metal is not carried out.

Further, as another solving means for the above-mentioned object, the present invention provides a production process of a plating resin molded article which comprises a step of removal of fat from the resin molded article which contains a polyamide-based resin and a styrene-based resin and a step of electroless plating and does not include a step of etching by an acid containing a heavy metal.

Mode (3) (Contact-Treatment with Acid or Base)

It is an object of the present invention to provide a production process of a plated resin molded article which does not require an etching treatment by chromic acid and the like and obtains a plated resin molded article having a high adhering strength between the resin molded article and a plating layer and having a beautiful appearance.

As solving means of the above-mentioned object, the present invention provides a production process of a plated resin molded article which is a process of carrying out a metal plating on the surface of a thermoplastic resin molded article to produce the plated resin molded article, wherein a step of contact-treating the thermoplastic resin molded article with an acid or base not containing a heavy metal is included as the pre-treatment of the metal plating step.

In particular, in the present invention, it is preferable that an acid or base having a low concentration (less than 4 normal) is used as the acid or base in a step of contact-treating with an acid or base not containing a heavy metal. There are obtained excellent effects that safety is higher and drainage treatment becomes easy in comparison with a case of using an acid or base having a high concentration by the contact-treatment in addition to the improvement of the adhering strength of a plating layer.

MODE FOR CARRYING OUT THE INVENTION

The above-mentioned three modes of the invention will be described in detail below.

Mode (1) (Water-Soluble Substance)

The plated resin molded article of the present invention is a plated resin molded article having a metal plating layer on the surface of the thermoplastic resin molded article which contains a thermoplastic resin and a water-soluble substance, and those in which the thermoplastic resin molded article is not treated with an etching treatment by an acid containing heavy metals such as chromic acid.

The thermoplastic resin can be appropriately selected from those widely known in accordance with their uses, but in the present invention, a polyamide-based resin, a styrene-based resin, an olefin-based resin, a polyphenylene ether resin (PPE), a polyphenylene sulfone resin (PPS) and a polysulfone resin are preferable.

The polyamide-based resin is a polyamide-based resin which is formed by a diamine and a dicarboxylic acid and a copolymer thereof. For example, there are mentioned a nylon 66, a polyhexamethylenesebacamide (nylon 6,10), a polyhexamethylenedodecanamide (nylon 6,12), a polydodecamethylenedodecanamide (nylon 12,12), a polymethaxylyleneadipamide (nylon MXD6), a polytetramethyleneadipamide (nylon 4,6), and a mixture thereof and a copolymer; copolymers such as a nylon 6/66, a nylon 66/6T in which a 6T component is 50% by mol or less (6T: polyhexamethyleneterephthalamide), a nylon 66/6I in which a 6I component is 50% by mol or less (6I: polyhexamethyleneisophthalamide), a nylon 6T/6I/66 and a nylon 6T/6I/610; copolymers such as a polyhexamethyleneterephthalamide (nylon 6T), a polyhexamethyleneisophthalamide (nylon 6I), a poly(2-methylpentamethylene)terephthalamide (nylon M5T), a poly(2-methylpentamethylene)isophthalamide (nylon M5I), a nylon 6T/6I and a nylon 6T/M5T. Additionally, a copolymer nylon such as an amorphous nylon may be used, and as the amorphous nylon, a polycondensate of terephthalic acid and trimethylhexamethylene diamine and the like may be proposed.

Further, the ring opening polymer of a cyclic lactam, a polycondensate of an amino carboxylic acid and a copolymer consisting of these components, specifically, aliphatic polyamide resins such as a nylon 6, a poly(ω-undecanamide) (nylon 11) and a poly(ω-dodecanamide) (nylon 12), and a copolymer thereof; a copolymer with a polyamide consisting of a diamine and a dicarboxylic acid, specifically, a nylon 6T/6, a nylon 6T/11, a nylon 6T/12, a nylon 6T/6I/12, a nylon 6T/6I/610/12 and the like, and a mixture thereof can be included.

As the polyamide-based resin, a PA (nylon) 6, a PA (nylon) 66 and a PA (nylon) 6/66 are preferable among the above-mentioned polyamide resins.

As the styrene-based resin, polymers of styrene and styrene derivatives such as an α-substituted styrene and a nuclei-substituted styrene can be included. Further, a copolymer constituted by mainly these monomers with monomers of vinyl compounds such as acrylic acid and methacrylic acid and/or conjugated diene compounds such as butadiene and isoprene is also included. For example, a polystyrene, a high impact polystyrene (HIPS) resin, an acrylonitrile-butadiene-styrene copolymer (ABS) resin, an acrylonitrile-styrene copolymer (AS resin), a styrene-methacrylate copolymer (MS resin), a styrene-butadiene copolymer (SBS resin) and the like can be included.

Further, as the polystyrene-based resin, a styrene-based copolymer in which a carboxyl group-containing unsaturated compound for enhancing compatibility with the polyamide-based resin is copolymerized may be included. The styrene-based copolymer in which a carboxyl group-containing unsaturated compound is copolymerized is a copolymer which is obtained by polymerizing the carboxyl group-containing unsaturated compound and if necessary, other monomers which can be copolymerizable with these, in the presence of a rubber-like polymer. The components are specifically exemplified:

1) a grafted polymer obtained by polymerizing a monomer in which an aromatic vinyl monomer is an essential component or monomers in which an aromatic vinyl and an unsaturated compound containing a carboxyl group are essential components, in the presence of a rubbery polymer copolymerized with an unsaturated compound containing a carboxyl group, 2) a grafted copolymer obtained by copolymerizing an aromatic vinyl monomer with a monomer in which an unsaturated compound containing a carboxyl group is an essential component, in the presence of a rubbery polymer, 3) a mixture of a rubber reinforced styrene-based resin in which an unsaturated compound containing a carboxyl group is not copolymerized, with a copolymer of monomers in which an aromatic vinyl and an unsaturated compound containing a carboxyl group are essential components, 4) a mixture of the above-mentioned 1) and 2), with a copolymer of monomers in which an aromatic vinyl and an unsaturated compound containing a carboxyl group are essential components, and 5) a mixture of the above-mentioned 1), 2), 3) and 4), with a copolymer of a monomer in which an aromatic vinyl is an essential component.

In the above-mentioned 1), 2), 3), 4) and 5), styrene is preferable as the aromatic vinyl, and acrylonitrile is preferable as the monomer which is copolymerized with the aromatic vinyl. The unsaturated compound containing a carboxyl group in the styrene-based resin is preferably 0.1 to 8% by weight and more preferably 0.2 to 7% by weight.

The olefin-based resin is a polymer in which a mono-olefin having 2 to 8 carbons is the main monomer component, and there can be included one kind or more polymers which are selected from a low density polyethylene, a high density polyethylene, a linear low density polyethylene, a polypropylene, an ethylene-propylene random copolymer, an ethylene-propylene block copolymer, a polymethylpentene, a poly (1-butene), and a modified product thereof and the like. Among these, a polypropylene and an acid-modified polypropylene are preferable.

The water-soluble substance includes polysaccharides such as starch, dextrin, pulrane, hyaluronic acid, carboxymethyl cellulose, methyl cellulose ethyl cellulose, or a salt thereof; poly-valent alcohols such as propylene glycol, ethylene glycol, diethylene glycol, neopentyl glycol, butanediol, pentanediol, polyoxyethylene glycol, polyoxypropylene glycol, trimethylol propane, pentaerythritol dipentaerythritol and glycerin; polyvinylalcohol, polyacrylic acid, polymaleic acid, polyacrylamide, polyvinyl pyrrolidone, polyethylene oxide, acrylic acid-maleic anhydride copolymer, maleic anhydride-diisobutylene copolymer, maleic anhydride-vinyl acetate copolymer, a polycondensate of naphthalene sulfonate with formalin and a salt thereof.

The content rate of the thermoplastic resin and the water-soluble substance in the resin molded article is 0.01 to 50 parts per mass of the water-soluble substance per 100 parts per mass of the thermoplastic resin, more preferably 0.01 to 30 parts per mass and further preferably 0.01 to 15 parts per mass.

The plated resin molded article of the present invention is preferably one containing a surfactant and/or a coagulant in the resin molded article in order to enhance the adhering strength of a plating layer. As this surfactant and/or coagulant, a surfactant (emulsifier) which is used when an emulsion polymerization is applied in producing the thermoplastic resin may remain in the resin, and when a production process which does not use an emulsifier such as a bulk polymerization is applied, those separately added in the thermoplastic resin may be used.

The surfactant and/or coagulant may be other than those which are used in the emulsion polymerization, in addition to those which are used in the emulsion polymerization, and the surfactant is preferably selected from an anionic surfactant, a cationic surfactant, a nonionic surfactant, and an amphoteric surfactant.

As these surfactants, anionic surfactants such as a salt of an aliphatic acid, a salt of rosin acid, an alkyl sulfonate, an alkylbenzene sulfonate, an alkyldiphenyl ether sulfonate, a polyoxyethylenealkyl ether sulfonate, a diester salt of sulfosuccinic acid, an ester salt of an α-olefin sulfonic acid, and an α-olefin sulfonate; cationic surfactants such as a mono or dialkylamine or a polyoxyethylene adduct thereof, and a mono or di-long chain alkyl quaternary ammonium salt; nonionic surfactants such as an alkyl glucoside, a polyoxyethylenealkyl ether, a polyoxyethylenealkyl phenyl ether, a sucrose ester of an aliphatic acid, a sorbitan ester of an aliphatic acid, a polyoxyethylene sorbitan ester of an aliphatic acid, a polyoxyethylene ester of an aliphatic acid, a polyoxyethylene-propylene block copolymer, a mono glyceride of an aliphatic acid, and an amine oxide; amphoteric surfactants such as carbobetaine, sulfobetaine, and hydroxysulfobetaine are included.

The content rate of the surfactant and/or coagulant in the resin molded article is preferably 0.01 to 10 parts per mass of the surfactant and/or coagulant per 100 parts per mass of the thermoplastic resin, more preferably 0.01 to 5 parts per mass and further preferably 0.01 to 2 parts per mass.

For the plated resin molded article of the present invention, the adhering strength (JIS H8630) between the resin molded article and the metal plating layer has preferably the highest value of 10 kPa or more, more preferably the highest value of 50 kPa or more, further preferably the highest value of 100 kPa or more, and particularly preferably the highest value of 150 kPa or more.

The shape of the plated resin molded article, the kind and thickness of the plating layer, and the like of the present invention can be suitably selected according to the use, and can be applied to various uses, but it is suitable for use as automobile parts such as a bumper, an emblem, a wheel cap, interior parts, and exterior parts.

Then, the production process of the plated resin molded article of the present invention will be described by its steps. The production process of the present invention has a step of carrying out the removal of fat and an electroless plating step, and it is desirable that at least a step of treating with a catalyst-imparting liquid between the aforementioned two steps is provided. Further, if necessary, a usual treatment step which is carried out by those skilled in the art can be appropriately added.

First, the removal of fat from the resin molded article which contains the thermoplastic resin and the water-soluble substance and further, if necessary, a surfactant and the like is carried out. Further, the resin molded article is obtained by molding in a desired shape which is suitable for use, by known methods such as an injection molding.

The removal of fat is carried out by a surfactant aqueous solution which contains an alkali such as sodium hydroxide and sodium carbonate, or acids such as sulfuric acid and carbonic acid. In the present invention, after the removal of fat, the article can be transferred to the electroless plating step or other steps, and an etching treatment by an acid containing heavy metals such as chromic acid which becomes a roughening treatment for enhancing the adhering strength of a plating layer is unnecessary.

After the removal of fat, for example, a step of washing with water, a step of treating with a catalyst-imparting liquid, a step of washing with water, a step of treating with an activating liquid (activation step) and a step of washing with water can be carried out. Further, the step of treating with a catalyst-imparting liquid and the step of treating with an activating liquid can be simultaneously carried out.

In the treatment by a catalyst-imparting liquid, the article is immersed, for example, in a 35% hydrochloric acid solution (10 to 20 $mgl^{-1}$) of stannic chloride (20 to 40 $gl^{-1}$) for about 1 to 5 minutes at room temperature. In the treatment by an activating liquid, the article is immersed in a 35% hydrochloric acid solution (3 to 5 $mgl^{-1}$) of palladium chloride (0.1 to 0.3 $gl^{-1}$) for about 1 to 2 minutes at room temperature.

Then, the electroless plating step is carried out once or twice or more. As the plating bath, those containing nickel, copper, cobalt, a nickel-cobalt alloy, gold and the like and reducing agents such as formalin and hypophosphite can be used. The pH and temperature of the plating bath are selected in accordance with the kind of the plating bath used.

When the plating treatment is further carried out after the electroless plating, an electroplating step by copper and the like can be also added after activation treatment by an acid or an alkali.

Mode (2) Polyamide-Based Resin and Styrene-Based Resin

The plated resin molded article of the present invention is a plated resin molded article which has a metal plating layer on the surface of the resin molded article containing a polyamide-based resin and a styrene-based resin, and the resin molded article is a resin molded article which is not treated with an etching treatment by an acid containing heavy metals such as chromic acid.

The polyamide-based resin which constitutes the resin molded article is exemplified in the same manner as in the mode (1).

The styrene-based resin which constitutes the resin molded article can be exemplified in the same manner as in the mode (1).

The content of the polyamide-based resin in the resin molded article is preferably 90 to 10% by weight, more preferably 80 to 20% by weight and further preferably 70 to 30% by weight, and the content of the styrene-based resin is preferably 10 to 90% by weight, more preferably 20 to 80% by weight and further preferably 30 to 70% by weight.

It is similar as the mode (1) that the plated resin molded article of the present invention is preferably one containing a surfactant and/or a coagulant in the resin molded article in order to enhance the adhering strength of a plating layer.

The surfactant and/or coagulant are preferably contained in the resin molded article by 20% by weight or less, more preferably contained by $1.0\times10^{-6}$ to 20% by weight, and further preferably contained by $1.0\times10^{-2}$ to 20% by weight.

For the plated resin molded article of the present invention, the adhering strength (JIS H8630) between the resin molded article and the plating layer is similar as the mode (1).

The shape of the plated resin molded article, the kind and thickness of the plating layer, the production process and the like of the present invention are similar as the mode (1).

Mode (3) (Contact-Treatment with Acid or Base)

The production process of the plated resin molded article of the present invention is not specifically limited, so far as it includes a step (hereinafter, referred to as "contact-treatment step with an acid or the like") of carrying out the contact-treatment of a thermoplastic resin molded article with an acid or base which does not contain a heavy metal, as the pretreatment of the metal plating step. The under-mentioned treatment steps can be partially deleted and a known plating step can be added. One mode of operation which includes the contact-treatment step with an acid or the like will be described below.

First, the removal of fat from the thermoplastic resin molded article is carried out. Further, the thermoplastic resin molded article is obtained by being molded into a desired shape which is suitable for use, by known methods such as an injection molding.

The removal of fat is carried out by a surfactant aqueous solution which contains an alkali such as sodium hydroxide and sodium carbonate, or acids such as sulfuric acid and carbonic acid. In the present invention, after the removal of fat, the article can be transferred to other steps, and an etching treatment by an acid containing a heavy metal, such as chromic acid, which becomes a roughening treatment for enhancing the adhering strength of a plating layer is unnecessary.

Then, the contact-treatment step with an acid or the like is carried out for the thermoplastic resin molded article after the fat removal treatment. As the acid or base not containing a heavy metal which is used in this step, an acid or base having a low concentration is preferable, and preferably is 4 normal or less, more preferably 3.5 normal or less, and further preferably 3.0 normal or less.

It has been conventionally desirable that the surface of a resin molded article is roughened by an etching treatment using an acid or base having a high concentration, in order to enhance the adhering strength of a plating layer. However, in the preferable mode of the present invention, the adhering strength of a plating layer can be enhanced by adding the contact-treatment step with an acid or base having a low concentration. As a result, an effect that safety at working is enhanced and drainage treatment becomes easy can be obtained in combination.

For the treatment of this step, for example, a method of immersing the thermoplastic resin molded article in an acid or base which does not contain a heavy metal can be applied, and a method of immersing it in an acid or base at a liquid temperature of 10 to 80° C. which does not contain a heavy metal for 0.5 to 20 minutes can be applied.

As the acid which does not contain a heavy metal, an acid and the like which is selected from organic acids such as acetic acid, citric acid and formic acid in addition to hydrochloric acid, phosphoric acid and sulfuric acid can be used. As the base which does not contain a heavy metal, a base and the like which are selected from the hydroxides of an alkali metal or an alkali earth metal such as sodium hydroxide, potassium hydroxide, calcium hydroxide and magnesium hydroxide can be used.

After the contact-treatment step with an acid or the like, for example, a step of washing with water, a step of treating with a catalyst-imparting liquid, a step of washing with water, a step of treating with an activating liquid (activation step) and a step of washing with water can be carried out. Further, the step of treating with a catalyst-imparting liquid and the step of treating with an activating liquid can be simultaneously carried out.

In the treatment by a catalyst-imparting liquid, the article is immersed, for example, in a 35% hydrochloric acid solution (10 to 20 $mgl^{-1}$) of stannic chloride (20 to 40 $gl^{-1}$) for about 1 to 5 minutes at room temperature. In the treatment by an activating liquid, the article is immersed in a 35% hydrochloric acid solution (3 to 5 $mgl^{-1}$) of palladium chloride (0.1 to 0.3 $gl^{-1}$) for about 1 to 2 minutes at room temperature.

Then, the electroless plating step is carried out once or twice or more, if necessary. As the plating bath, those containing nickel, copper, cobalt, a nickel-cobalt alloy, gold and the like and reducing agents such as formalin and hypophosphite can be used. The pH and temperature of the plating bath are selected in accordance with the kind of the plating bath used.

When the plating treatment is further carried out after the electroless plating, an electroplating step by copper and the like can be also added after an activation treatment by an acid or an alkali.

The thermoplastic resin molded article which is used in the production process of the present invention is preferably a thermoplastic resin molded article which contains the thermoplastic resin, and further, the water-soluble substance, the surfactant, the coagulant and the like, in order to enhance the adhering strength of a plating layer.

The thermoplastic resin can be appropriately selected from those widely known in accordance with their uses, but in the present invention, a polyamide-based resin, a styrene-based resin, an olefin-based resin, a polyphenylene ether resin (PPE), a polyphenylene sulfone resin (PPS), a polysulfone resin, an acryl-based resin, a cellulose-based resin or an alloy thereof is preferable. Further, among these resins and an alloy, a resin and an alloy which has a good reactivity with an aqueous solution and are hygroscopic are more preferable, and a resin and an alloy in which a saturated water absorption rate (JIS K6911, K7209) is 0.6% or more is preferable in particular.

The polyamide-based resin is similar as the mode (1).

The styrene-based resin is similar as the mode (1).

The olefin-based resin is similar as the mode (1).

The water-soluble substance is similar as the mode (1).

The content rate of the thermoplastic resin and the water-soluble substance in the thermoplastic resin molded article is 0.01 to 50 parts per mass of the water-soluble substance per 100 parts per mass of the thermoplastic resin, more preferably 0.01 to 30 parts per mass and further preferably 0.01 to 15 parts per mass.

The surfactant and the coagulant may be used in the same manner as the mode (1).

Those having a high adhering strength between the thermoplastic resin molded article and the metal plating layer can be obtained by applying the production process of the present invention in the same manner as the mode (1).

The plated resin molded article which is obtained by applying the production process of the present invention can be applied to various uses in the same manner as the mode (1).

Though the plated resin molded article of the present invention is not treated with an etching treatment by an acid containing heavy metals such as chromic acid, it has a plating layer having a high adhering strength. Further, since the etching treatment by an acid containing heavy metals such as chromic acid is not carried out, drainage treatment is easy, and there is no environmental pollution due to the heavy metals.

According to the production process of the present invention, a plated resin molded article having a high adhering strength between the thermoplastic resin molded article and a plating layer and having a beautiful appearance can be obtained. In particular, the present invention is superior in a point in which the aforementioned plated resin molded article is obtained without carrying out the acid treatment containing heavy metals such as chromic acid and by treatment of a moderate condition, in comparison with a conventional plating method.

EXAMPLES

The modes (1), (2) and (3) of the invention are described according to Examples. Examples 1 to 88 correspond to the mode (1), Examples 101 to 119 correspond to the mode (2), and Examples 121 to 123 correspond to the mode (3).

The symbols of each components in the tables have the same meanings as described in the Examples.

The present invention is more specifically described below based on the Examples, but the present invention is not limited to these Examples. Further, the adherence test of a plating layer carried out in the Examples and Comparative Examples and the details of components used therein are as follows.

(1) Adherence Test of Plating Layer

The adhering strength (the highest value) between the resin molded article and a metal plating layer was measured according to the adherence test method described in appendix 6 in JIS H8630 using the plated resin molded articles obtained in the Examples and Comparative Examples.

(2-1) Components Used for Mode (1)

(A) Thermoplastic Resin (A-1): Polyamide 6 (UBENYLON 1013B, manufactured by UBE Industries, Ltd.)

(A-2): Polyamide 66 (UBENYLON 2020B, manufactured by UBE Industries, Ltd.)

(A-3): AS resin (styrene amount: 75% by weight, acrylonitrile: 25% by weight)

(A-4): ABS resin (styrene amount: 45% by weight, acrylonitrile: 15% by weight, rubber amount: 40% by weight)

(A-5): Acid-modified ABS resin (styrene amount: 42% by weight, acrylonitrile: 16% by weight, rubber amount: 40% by weight, methacrylic acid: 2% by weight)

(A-6): Acid-modified ABS resin (styrene amount: 40% by weight, acrylonitrile: 14% by weight, rubber amount: 40% by weight, methacrylic acid: 6% by weight)

(A-7): Polypropylene resin (J713M, manufactured by GRAND POLYMER Co., Ltd.)

(A-8): Acid-modified polypropylene resin (E109H, manufactured by GRAND POLYMER Co., Ltd.)

(B) Water-Soluble Substance (B-1): Dipentaerythritol (manufactured by KOEI Chemical Co., Ltd.)

(B-2): Pentaerythritol (manufactured by KOEI Chemical Co., Ltd.)

(C) Surfactant (C-1): α-olefin sulfonate: LIPOLAN PB800 (manufactured by LION Corporation)

(C-2): Potassium salt of rosin acid (C-3): Potassium oleate (C-4): Potassium laurate (2-2) Components used for Mode (2)

(A) Component: Polyamide (A-1): Standard molecular weight Polyamide 6 (number average molecular weight: 16,000).

(B) Component: Bulk Polymerization Styrene-Based Resin (B-1): Styrene amount: 75% by weight, acrylonitrile: 25% by weight.

(B-2): Styrene amount: 60% by weight, acrylonitrile: 20% by weight, rubber amount: 20% by weight.

(C) component: Emulsion Polymerization Styrene-Based Resin (C-1): Styrene amount: 75% by weight, acrylonitrile: 25% by weight.

(C-2): Styrene amount: 60% by weight, acrylonitrile: 20% by weight, rubber amount: 20% by weight.

(C-3): Styrene amount: 45% by weight, acrylonitrile: 15% by weight, rubber amount: 40% by weight.

(C-4): Styrene amount: 30% by weight, acrylonitrile: 10% by weight, rubber amount: 60% by weight.

(C-5): Styrene amount: 40% by weight, acrylonitrile: 15% by weight, rubber amount: 40% by weight, carboxylic acid amount: 5% by weight.

(D) Component: Surfactant (Emulsifier)

(D-1): Potassium salt of rosin acid (D-2): Potassium oleate (D-3): Potassium laurate (D-4): α-olefin sulfonate: LIPOLAN PB-800 (manufactured by LION Corporation)

(D-5): α-olefin sulfonate: LIPOLAN PJ-400 (manufactured by LION Corporation)

(2-3) Components Used for Mode (3)

Test pieces of 100×50×3 mm obtained by injection molding each of the compositions consisting of components shown in Tables 9 and 10 (a cylinder temperature of 240° C., and a mold temperature of 60° C.) were used. The details of the respective components described in Table 9 are as described below.

(A: Thermoplastic Resin)

(A-1): Trade mane "NOVALOY A1300" manufactured by DAICEL POLYMER Ltd. (polyamide/ABS resin)

(A-2): Trade name "NOVALOY A1500" manufactured by DAICEL POLYMER Ltd. (polyamide/ABS resin)

(A-3): Trade name "NOVALOY A1700" manufactured by DAICEL POLYMER Ltd. (polyamide/ABS resin)

(A-4): Trade name "NOVALOY A2602" manufactured by DAICEL POLYMER Ltd. (polyamide/ABS resin)

(B: Water-Soluble Substance)

B-1: Dipentaerythritol (manufactured by KOEI Chemical Co., Ltd.)

(C: Surfactant)

(C-1): α-olefin sulfonate (LIPOLAN PB-800: manufactured by LION Corporation)

Examples 1 to 88 and Comparative Examples 1 to 9

The compositions (a thermoplastic resin is indicated by % by weight and other components are indicated by parts by weight per 100 parts by weight of the thermoplastic resin) which have the combination and ratio shown in Table 1 were used, mixed in a V-type tumbler, and then melt-kneaded in a twin screw extruder (TEX30, manufactured by NIHON SEIKOU Co., Ltd., and a cylinder temperature of 230° C.) to obtain pellets. Then, a molded article of 100×50×3 mm was obtained by an injection molding machine (a cylinder temperature of 240° C., and a mold temperature of 60° C.), and electroless plating was carried out using the molded article as a test piece according to the order of steps described below to obtain a plated resin molded article. The test result is shown in Table 1.

(Production Process of Plated Resin Molded Article)

(1) Fat removal step: The test piece was immersed in a 50 g/L aqueous solution (a solution temperature of 40° C.) of ACE-CLEAN A-220 (manufactured by OKUNO Pharmaceuticals Co., Ltd.) for 20 minutes.

(2) Catalyst imparting step: The test piece was immersed in a mixed aqueous solution (a solution temperature of 25° C.) of 150 ml/L of 35% by weight of hydrochloric acid and 40 ml/L aqueous solution of Catalyst C (manufactured by OKUNO Pharmaceuticals Co., Ltd.) for 3 minutes.

(3) The first activation step: The test piece was immersed in a 100 ml/L aqueous solution (a solution temperature of 40° C.) of 98% by weight of sulfuric acid for 3 minutes.

(4) The second activation step: The test piece was immersed in 15 g/L aqueous solution (a solution temperature of 40° C.) of sodium hydroxide for 2 minutes.

(5) Electroless plating step of nickel: The test piece was immersed in a mixed aqueous solution (a solution temperature of 40° C.) of 150 ml/L of Chemical Nickel HR-TA (manufactured by OKUNO Pharmaceuticals Co., Ltd.) and 150 ml/L of Chemical Nickel HR-TB (manufactured by OKUNO Pharmaceuticals Co., Ltd.) for 5 minutes.

(6) Acid activation step: The test piece was immersed in 100 g/L aqueous solution (a solution temperature of 25° C.) of TOP SAN (manufactured by OKUNO Pharmaceuticals Co., Ltd.) for one minute.

(7) Electroplating step of copper: The test piece was immersed in a plating bath having the under-mentioned composition (a solution temperature of 25° C.), and electroplating was carried out for 120 minutes.

(Composition of Plating Bath)

Copper sulfate ($CuSO_4$□$5H_2O$): 200 g/L

Sulfuric acid (98%): 50 g/L

Chlorine ion ($Cl^-$): 5 ml/L

TOP LUCINA 2000 MU (manufactured by OKUNO Pharmaceuticals Co., Ltd.): 5 ml/L

TOP LUCINA 2000 A (manufactured by OKUNO Pharmaceuticals Co., Ltd.): 0.5 ml/L

Examples 101 to 119 and Comparative Examples 11 and 12

The compositions ((A), (B) and (C) components are indicated by % by weight and (D) component is indicated by parts by weight per 100 parts by weight of the total of (A) to (C) components) which has the combination and ratio shown in Table 7 were used, mixed in a V-type tumbler, and then melt-kneaded in a twin screw extruder (TEX30, manufactured by NIHON SEIKOU Co., Ltd., a cylinder temperature of 230° C.) to obtain pellets. Then, a molded article of 100×50×3 mm was obtained by an injection molding machine (a cylinder temperature of 240° C. and a mold temperature of 60° C.), and electroless plating was carried out using the molded article as a test piece according to the order of steps described below to obtain a-plated resin molded article. The test result is shown in Tables 7 and 8.

The production process of a plated resin molded article was similar as in Example 1.

Examples 121

The thermoplastic resin molded article consisting of components in Tables 9 and 10 was used, and a plated resin molded article was obtained according to the steps below. The adherence of the plating layer is shown in Table 10.

(1) Fat removal step: The test piece was immersed in a 50 g/L aqueous solution (a solution temperature of 40° C.) of ACE-CLEAN A-220 (manufactured by OKUNO Pharmaceuticals Co., Ltd.) for 20 minutes.

(2) Contact-treatment step by acid: The test piece was immersed in a 100 ml aqueous solution (a solution temperature of 40° C.) of 1.0 normal hydrochloric acid for 5 minutes.

The (3) catalyst imparting step, (4) the first activation step, (5) the second activation step, (6) electroless plating step of nickel, (7) acid activation step and (8) electroplating step of copper were respectively carried out in the same manner as (2) to (7) in Example 1.

Examples 122

The thermoplastic resin molded article consisting of components in Tables 9 and 10 was used, and a plated resin molded article was obtained according to the steps below. The adherence of the plating layer is shown in Table 10.

(1) Fat removal step: The test piece was immersed in a 50 g/L aqueous solution of ACECLEAN A-220 (manufactured by OKUNO Pharmaceuticals Co., Ltd.) for 20 minutes.

(2) Contact-treatment step by acid: The test piece was immersed in a 100 ml aqueous solution (a solution temperature of 40° C.) of 2.0 normal hydrochloric acid for 5 minutes.

(3) Catalyst imparting step: The test piece was immersed in a mixed aqueous solution (a solution temperature of 25° C.) of 150 ml/L of 35% by weight of hydrochloric acid and 40 ml/L aqueous solution of Catalyst C (manufactured by OKUNO Pharmaceuticals Co., Ltd.) for 3 minutes. A plated resin molded article was obtained in the same manner as in Example 121 thereafter.

Examples 123

The thermoplastic resin molded article consisting of the components in Tables 9 and 10 was used, and a plated resin molded article was obtained according to the steps below. The adherence of the plating layer is shown in Table 10.

(1) Fat removal step: The test piece was immersed in a 50 g/L aqueous solution (a solution temperature of 40° C.) of ACECLEAN A-220 (manufactured by OKUNO Pharmaceuticals Co., Ltd.) for 20 minutes.

(2) Contact-treatment step by acid: The test piece was immersed in 5 normal hydrochloric acid (a solution temperature of 40° C.) for 5 minutes.

(3) Catalyst imparting step: The test piece was immersed in a mixed aqueous solution (a solution temperature of 25° C.) of 150 ml/L of 35% by weight of hydrochloric acid and a 40 ml/L aqueous solution of Catalyst C (manufactured by OKUNO Pharmaceuticals Co., Ltd.) for 3 minutes. A plated resin molded article was obtained in the same manner as in Example 121 thereafter.

Comparative Example 13

The thermoplastic resin molded article consisting of components in Tables 9 and 10 was used, and a plated resin molded article was obtained according to the steps below. The adherence of the plating layer is shown in Table 10.

(1) Fat removal step: The test piece was immersed in a 50 g/L aqueous solution (a solution temperature of 40° C.) of ACECLEAN A-220 (manufactured by OKUNO Pharmaceuticals Co., Ltd.) for 20 minutes.

(2) Etching step: The test piece was immersed in a mixed aqueous solution (a solution temperature of 40° C.) of 400 g/L of anhydrous chromic acid and 200 ml/L of 98% by weight of sulfuric acid for 5 minutes.

(3) Catalyst imparting step: The test piece was immersed in a mixed aqueous solution (a solution temperature of 25° C.) of 150 ml/L of 35% by weight of hydrochloric acid and a 40 ml/L aqueous solution of Catalyst C (manufactured by OKUNO Pharmaceuticals Co., Ltd.) for 3 minutes. A plated resin molded article was obtained in the same manner as in Example 121 thereafter.

TABLE 1

| | Example | | | | | | | | | | | | | | | | | |
|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 |
| (A-1) | 100 | 100 | | | | | | | | | | | 60 | 60 | 50 | 50 | 40 | 40 |
| (A-2) | | | 100 | 100 | | | | | | | | | | | | | | |
| (A-3) | | | | | 50 | 50 | 50 | 50 | | | | | | | | | 10 | 10 |
| (A-4) | | | | | 50 | 50 | 40 | 40 | | | | | 30 | 30 | 40 | 40 | 40 | 40 |
| (A-5) | | | | | | | | | | | | | | | | | | |
| (A-6) | | | | | | | 10 | 10 | | | | | 10 | 10 | 10 | 10 | 10 | 10 |
| (A-7) | | | | | | | | | 100 | 100 | 90 | 90 | | | | | | |
| (A-8) | | | | | | | | | | | 10 | 10 | | | | | | |
| (B-1) | 5 | 10 | 5 | 10 | 5 | 10 | 5 | 10 | 5 | 10 | 5 | 10 | 5 | 10 | 5 | 10 | 5 | 10 |
| (B-2) | | | | | | | | | | | | | | | | | | |
| adhering strength (kPa) | 47 | 58 | 46 | 56 | 32 | 43 | 55 | 66 | 23 | 35 | 45 | 52 | 65 | 85 | 55 | 70 | 50 | 63 |

TABLE 2

| | Example | | | | | | | | | | | | | | | | | |
|---|---|---|---|---|---|---|---|---|---|---|---|---|---|---|---|---|---|---|
| | 19 | 20 | 21 | 22 | 23 | 24 | 25 | 26 | 27 | 28 | 29 | 30 | 31 | 32 | 33 | 34 | 35 | 36 |
| (A-1) | 100 | 100 | | | | | | | | | | | 60 | 60 | 50 | 50 | 40 | 40 |
| (A-2) | | | 100 | 100 | | | | | | | | | | | | | | |
| (A-3) | | | | | 50 | 50 | 50 | 50 | | | | | | | | | 10 | 10 |
| (A-4) | | | | | 50 | 50 | 40 | 40 | | | | | 30 | 30 | 40 | 40 | 40 | 40 |
| (A-5) | | | | | | | | | | | | | | | | | | |
| (A-6) | | | | | | | 10 | 10 | | | | | 10 | 10 | 10 | 10 | 10 | 10 |
| (A-7) | | | | | | | | | 100 | 100 | 90 | 90 | | | | | | |
| (A-8) | | | | | | | | | | | 10 | 10 | | | | | | |
| (B-1) | | | | | | | | | | | | | | | | | | |
| (B-2) | 5 | 10 | 5 | 10 | 5 | 10 | 5 | 10 | 5 | 10 | 5 | 10 | 5 | 10 | 5 | 10 | 5 | 10 |
| adhering strength (kPa) | 48 | 61 | 48 | 58 | 35 | 47 | 58 | 68 | 25 | 38 | 47 | 55 | 68 | 88 | 58 | 72 | 55 | 65 |

TABLE 3

| | Example | | | | | | | | | | | | | | | | | |
|---|---|---|---|---|---|---|---|---|---|---|---|---|---|---|---|---|---|---|
| | 37 | 38 | 39 | 40 | 41 | 42 | 43 | 44 | 45 | 46 | 47 | 48 | 49 | 50 | 51 | 52 | 53 | 54 |
| (A-1) | 100 | 100 | | | | | | | | | | | 60 | 60 | 50 | 50 | 40 | 40 |
| (A-2) | | | 100 | 100 | | | | | | | | | | | | | | |
| (A-3) | | | | | 50 | 50 | 50 | 50 | | | | | | | | | 10 | 10 |
| (A-4) | | | | | 50 | 50 | 40 | 40 | | | | | 30 | 30 | 40 | 40 | 40 | 40 |
| (A-5) | | | | | | | | | | | | | | | | | | |
| (A-6) | | | | | | | 10 | 10 | | | | | 10 | 10 | 10 | 10 | 10 | 10 |
| (A-7) | | | | | | | | | 100 | 100 | 90 | 90 | | | | | | |
| (A-8) | | | | | | | | | | | 10 | 10 | | | | | | |
| (B-1) | 5 | 10 | 5 | 10 | 5 | 10 | 5 | 10 | 5 | 10 | 5 | 10 | 5 | 10 | 5 | 10 | 5 | 10 |
| (B-2) | | | | | | | | | | | | | | | | | | |
| (C-1) | 2 | 2 | 2 | 2 | 2 | 2 | 2 | 2 | 2 | 2 | 2 | 2 | 2 | 2 | 2 | 2 | 2 | 2 |
| (C-2) | | | | | | | | | | | | | | | | | | |
| (C-3) | | | | | | | | | | | | | | | | | | |
| (C-4) | | | | | | | | | | | | | | | | | | |
| adhering strength (kPa) | 53 | 65 | 55 | 62 | 40 | 52 | 61 | 70 | 30 | 45 | 55 | 62 | 180 | 250 | 140 | 150 | 100 | 112 |

TABLE 4

| | Example | | | | | | | | | | | | | | | | | |
|---|---|---|---|---|---|---|---|---|---|---|---|---|---|---|---|---|---|---|
| | 55 | 56 | 57 | 58 | 59 | 60 | 61 | 62 | 63 | 64 | 65 | 66 | 67 | 68 | 69 | 70 | 71 | 72 |
| (A-1) | 100 | 100 | | | | | | | | | | | 60 | 60 | 50 | 50 | 40 | 40 |
| (A-2) | | | 100 | 100 | | | | | | | | | | | | | | |
| (A-3) | | | | | 50 | 50 | 50 | 50 | | | | | | | | | 10 | 10 |
| (A-4) | | | | | 50 | 50 | 40 | 40 | | | | | 30 | 30 | 40 | 40 | 40 | 40 |
| (A-5) | | | | | | | | | | | | | | | | | | |
| (A-6) | | | | | | | 10 | 10 | | | | | 10 | 10 | 10 | 10 | 10 | 10 |
| (A-7) | | | | | | | | | 100 | 100 | 90 | 90 | | | | | | |
| (A-8) | | | | | | | | | | | 10 | 10 | | | | | | |
| (B-1) | | | | | | | | | | | | | | | | | | |
| (B-2) | 5 | 10 | 5 | 10 | 5 | 10 | 5 | 10 | 5 | 10 | 5 | 10 | 5 | 10 | 5 | 10 | 5 | 10 |
| (C-1) | 2 | 2 | 2 | 2 | 2 | 2 | 2 | 2 | 2 | 2 | 2 | 2 | 2 | 2 | 2 | 2 | 2 | 2 |
| (C-2) | | | | | | | | | | | | | | | | | | |
| (C-3) | | | | | | | | | | | | | | | | | | |
| (C-4) | | | | | | | | | | | | | | | | | | |
| adhering strength (kPa) | 52 | 67 | 54 | 66 | 43 | 55 | 63 | 72 | 32 | 47 | 57 | 61 | 190 | 270 | 137 | 152 | 102 | 115 |

TABLE 5

| | Example | | | | | | | | | | | | | | | |
|---|---|---|---|---|---|---|---|---|---|---|---|---|---|---|---|---|
| | 73 | 74 | 75 | 76 | 77 | 78 | 79 | 80 | 81 | 82 | 83 | 84 | 85 | 86 | 87 | 88 |
| (A-1) | 60 | 60 | 60 | 60 | 60 | 60 | 60 | 60 | 60 | 60 | 60 | 60 | 60 | 60 | 60 | 60 |
| (A-2) | | | | | | | | | | | | | | | | |
| (A-3) | | | | | | | | | | | | | | | | |
| (A-4) | 30 | 30 | 30 | 30 | 30 | 30 | 30 | 30 | 30 | 30 | 30 | 30 | 30 | 30 | 30 | 30 |
| (A-5) | | | | | | | | | | | | | 10 | 10 | 10 | 10 |
| (A-6) | 10 | 10 | 10 | 10 | 10 | 10 | 10 | 10 | 10 | 10 | 10 | 10 | | | | |
| (A-7) | | | | | | | | | | | | | | | | |
| (A-8) | | | | | | | | | | | | | | | | |
| (B-1) | 5 | 10 | | | 5 | 10 | | | 5 | 10 | | | 10 | 10 | 10 | 10 |
| (B-2) | | | 5 | 10 | | | 5 | 10 | | | 5 | 10 | | | | |
| (C-1) | | | | | | | | | | | | | 2 | | | |
| (C-2) | 2 | 2 | 2 | 2 | | | | | | | | | | 2 | | |
| (C-3) | | | | | 2 | 2 | 2 | 2 | | | | | | | 2 | |
| (C-4) | | | | | | | | | 2 | 2 | 2 | 2 | | | | 2 |
| adhering strength (kPa) | 180 | 240 | 170 | 235 | 180 | 250 | 177 | 222 | 165 | 215 | 146 | 219 | 220 | 215 | 213 | 210 |

TABLE 6

| | Comparative Example | | | | | | | | |
|---|---|---|---|---|---|---|---|---|---|
| | 1 | 2 | 3 | 4 | 5 | 6 | 7 | 8 | 9 |
| (A-1) | 100 | | | | | | 60 | 50 | 40 |
| (A-2) | | 100 | | | | | | | |
| (A-3) | | | 50 | 50 | | | | | 10 |
| (A-4) | | | 50 | 40 | | | 30 | 40 | 40 |
| (A-5) | | | | | | | | | |
| (A-6) | | | | 10 | | | 10 | 10 | 10 |
| (A-7) | | | | | 100 | 90 | | | |
| (A-8) | | | | | | 10 | | | |
| (B-1) | | | | | | | | | |

TABLE 6-continued

| | Comparative Example | | | | | | | | |
|---|---|---|---|---|---|---|---|---|---|
| | 1 | 2 | 3 | 4 | 5 | 6 | 7 | 8 | 9 |
| (B-2) | | | | | | | | | |
| (C-1) | | | | | | | | | |
| (C-2) | | | | | | | | | |
| (C-3) | | | | | | | | | |
| (C-4) | | | | | | | | | |
| adhering strength (kPa) | 8 | 8 | 4 | 7 | 1 | 2 | 9 | 8 | 7 |

TABLE 7

| | | Example | | | | | | | | | | | | |
|---|---|---|---|---|---|---|---|---|---|---|---|---|---|---|
| | | 101 | 102 | 103 | 104 | 105 | 106 | 107 | 108 | 109 | 110 | 111 | 112 | 113 |
| (A) polyamide | (A-1) | 60 | 70 | 50 | 30 | 60 | 60 | 60 | 60 | 60 | 60 | 60 | 60 | 60 |
| (B) bulk polymerization | (B-1) | | | | | | 10 | | | | | | | |
| styrene-based resin | (B-2) | | | | | 30 | | 30 | 30 | 30 | | | | |
| (C) emulsion polymerization | (C-1) | | | | 20 | | | | | | | | | |
| styrene-based resin | (C-2) | | | | | | | | | | 30 | 30 | 30 | 30 |
| | (C-3) | 30 | 15 | 40 | 40 | | 20 | | | | | | | |
| | (C-4) | | | | | | | | | | | | | |
| | (C-5) | 10 | 15 | 10 | 10 | 10 | 10 | 10 | 10 | 10 | 10 | 10 | 10 | 10 |
| (D) emulsifying agent | (D-1) | | | | | | | 0.1 | | | | 0.1 | | |
| | (D-2) | | | | | | | | 0.1 | | | | 0.1 | |
| | (D-3) | | | | | | | | | 0.1 | | | | 0.1 |
| | (D-4) | | | | | | | | | | | | | |
| | (D-5) | | | | | | | | | | | | | |
| adhering strength (kPa) | | 58.8 | 49 | 49 | 39.2 | 49 | 49 | 58.8 | 58.8 | 58.8 | 49 | 58.8 | 58.8 | 58.8 |

TABLE 8

| | | Example | | | | | | Comparative Example | |
|---|---|---|---|---|---|---|---|---|---|
| | | 114 | 115 | 116 | 117 | 118 | 119 | 11 | 12 |
| (A) polyamide | (A-1) | 60 | 60 | 60 | 60 | 60 | 60 | 100 | |
| (B) bulk polymerization | (B-1) | | | | | | 10 | | |
| styrene-based resin | (B-2) | | | | | 30 | | | 100 |
| (C) emulsion polymerization | (C-1) | | | | | | | | |
| styrene-based resin | (C-2) | | | | | | | | |
| | (C-3) | | | | | | | | |
| | (C-4) | 30 | 30 | 30 | 30 | 30 | 30 | | |
| | (C-5) | 10 | 10 | 10 | 10 | 10 | 10 | | |
| (D) emulsifying agent | (D-1) | | 0.1 | | | | | | |
| | (D-2) | | | 0.1 | | | | | |
| | (D-3) | | | | 0.1 | | | | |
| | (D-4) | | | | | 2 | | | |
| | (D-5) | | | | | | 2 | | |
| adhering strength (kPa) | | 68.6 | 78.4 | 78.4 | 78.4 | 137.2 | 127.4 | 9.8 | 9.8 |

TABLE 9

| | Composition | | | | | | | |
|---|---|---|---|---|---|---|---|---|
| | 1 | 2 | 3 | 4 | 5 | 6 | 7 | 8 |
| A-1 | 100 | 100 | 100 | 100 | | | | |
| A-2 | | | | | 100 | 100 | 100 | 100 |
| A-3 | | | | | | | | |
| A-4 | | | | | | | | |
| B-1 | | 5 | | 5 | | 5 | | 5 |
| C-1 | | | 2 | 2 | | | 2 | 2 |
| Example 121 | 30-100 | 100-150 | 100-150 | 120-150 | 50-100 | 100-180 | 100-150 | 120-200 |
| Example 122 | 50-80 | 120-150 | 120-150 | 120-150 | 60-90 | 120-180 | 120-150 | 120-200 |
| Example 123 | 50-70 | 150-160 | 150-160 | 150-160 | 60-70 | 150-180 | 150-160 | 150-180 |

TABLE 9-continued

| | Composition | | | | | | | |
|---|---|---|---|---|---|---|---|---|
| | 1 | 2 | 3 | 4 | 5 | 6 | 7 | 8 |
| Comparative Example 13 | 0-10 | 0.0-10 | 0.0-10 | 0.0-10 | 0.0-10 | 0.0-10 | 0.0-10 | 0.0-10 |

TABLE 10

| | Composition | | | | | | | |
|---|---|---|---|---|---|---|---|---|
| | 9 | 10 | 11 | 12 | 13 | 14 | 15 | 16 |
| A-1 | | | | | | | | |
| A-2 | | | | | | | | |
| A-3 | 100 | 100 | 100 | 100 | | | | |
| A-4 | | | | | 100 | 100 | 100 | 100 |
| B-1 | | 5 | | 5 | | 5 | | 5 |
| C-1 | | | 2 | 2 | | | 2 | 2 |
| Example 121 | 40-100 | 100-170 | 100-150 | 120-150 | 50-100 | 100-150 | 100-150 | 120-180 |
| Example 122 | 50-90 | 120-150 | 120-170 | 120-150 | 60-90 | 120-180 | 120-150 | 120-200 |
| Example 123 | 60-80 | 150-160 | 150-160 | 150-160 | 60-80 | 150-160 | 150-160 | 150-160 |
| Comparative Example 13 | 0.0-10 | 0.0-10 | 0.0-10 | 0.0-10 | 0.0-10 | 0.0-10 | 0.0-10 | 0.0-10 |

As is clear from Tables 1 to 6, the adhering strength of the plating layer was remarkably improved by compounding the water-soluble substance in the resin molded article.

As is clear from Tables 7 and 8, the adhering strength of the plating layer was remarkably improved by compounding the surfactant in the resin molded article.

It was confirmed that the adhering strength of the plating layer was improved by providing a treatment step by diluted hydrochloric acid, from the comparison of Examples 121 and 122 with Comparative Example 13. Further, as is clear from the comparison of Examples 121 and 122 in which the treatment step of diluted hydrochloric acid (1.0 or 2.0 normal) with Example 123 using concentrated hydrochloric acid (5.0 normal), no difference in the adhering strength of the plating layer was confirmed. It was confirmed from the result that the treatment step using diluted hydrochloric acid is also superior in the improvement of working environment, the load reduction of drainage treatment and the like.

The invention claimed is:

1. A process for producing a plated resin molded article, comprising the steps of:

melt-kneading a thermoplastic resin consisting essentially of 70-30% by weight of a polyamide-based resin and 30-70% by weight of a styrene-based resin selected from the group consisting of a polystyrene resin, an acrylonitrile-butadiene-styrene copolymer resin, an acrylonitrile-styrene copolymer resin and a styrene-methacrylate copolymer resin with a water-soluble substance of at least one poly-valent alcohol selected from the group consisting of pentaerythritol and dipentaerythritol in an amount of 0.01 to 15 parts by mass per 100 parts by mass of the thermoplastic resin and, optionally, a surfactant selected from the group consisting of an α-olefin sulfonate, a potassium salt of rosin acid, potassium oleate and potassium laurate in an amount of 0.01 to 10 parts by mass per 100 parts by mass of the thermoplastic resin, forming a thermoplastic resin molded article consisting of the thermoplastic resin and the water-soluble substance and, optionally, the surfactant, contact-treating the thermoplastic resin molded article with an aqueous solution of an acid not containing a heavy metal or an aqueous solution of a base not containing a heavy metal, treating the thermoplastic resin molded article with a catalyst-imparting liquid to form a resultant thermoplastic resin molded article, treating the resultant thermoplastic resin molded article with an activating liquid, performing electroless plating on a surface of the resultant thermoplastic resin molded article that has been treated with the acid or base and the catalyst-imparting liquid, and then performing metal-electroplating on a surface of the resultant thermoplastic resin molded article.

2. The process of claim 1, wherein the contact-treating step is performed to remove fat from the thermoplastic resin molded article.

3. The process of claim 1, wherein the concentration of the acid or base used in the contact-treatment step is less than 4 N.

4. The process of claim 1, wherein the thermoplastic resin molded article is immersed in the acid or base during the contact-treatment step.

5. The process of claim 1, wherein the acid is selected from the group consisting of hydrochloric acid, phosphoric acid, sulfuric acid and an organic acid.

6. The process of claim 1, wherein the base is selected from the group consisting of a hydroxide of an alkali metal or an alkali earth metal.

7. The process of claim 1, wherein the styrene-based resin is an acrylonitrile-butadiene-styrene copolymer resin.

8. The process of claim 1, in which the thermoplastic resin further comprises a styrene-based copolymer in which a carboxyl group-containing unsaturated compound is copolymerized.

9. The process of claim 8, wherein the styrene-based copolymer in which a carboxyl group-containing unsaturated compound is copolymerized is an acid-modified acrylonitrile-butadiene-styrene copolymer resin.

10. The process of claim 1, wherein etching with an acid containing a heavy metal is not performed.

11. The process of claim 1, wherein the styrene-based resin is an acrylonitrile-styrene copolymer resin.

12. The process of claim 1, wherein the thermoplastic resin and the water-soluble substance are melt-kneaded together with the surfactant selected from the group consisting of α-olefin sulfonate, a potassium salt of rosin acid, potassium oleate and potassium laurate.

13. The process of claim 1, wherein the surfactant is also melt-kneaded with the thermoplastic resin.

14. The process of claim 1, wherein the polyamide-based resin is selected from the group consisting of polyamide 6 and polyamide 66 and is present in an amount of from 60-40% by weight and the styrene-based resin is selected from the group consisting of an acrylonitrile-butadiene-styrene copolymer resin and an acrylonitrile-styrene copolymer resin and is present in an amount of from 40-60% by weight.

15. The process of claim 14, wherein the polyamide-based resin is present in an amount of from 60-50% by weight and the styrene-based resin is present in an amount of from 40-50% by weight.

16. The process of claim 15, wherein the polyamide-based resin is present in an amount of 60% by weight and the styrene-based resin is present in an amount of 40% by weight.

* * * * *